US009549649B2

(12) United States Patent
Baek et al.

(10) Patent No.: US 9,549,649 B2
(45) Date of Patent: Jan. 24, 2017

(54) ROBOT CLEANER

(71) Applicant: LG Electronics Inc., Seoul (KR)

(72) Inventors: Ohhyun Baek, Changwon-si (KR); Moohyun Ko, Changwon-si (KR); Inbo Shim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 360 days.

(21) Appl. No.: 13/791,046

(22) Filed: Mar. 8, 2013

(65) Prior Publication Data

US 2013/0232718 A1 Sep. 12, 2013

(30) Foreign Application Priority Data

Mar. 8, 2012 (KR) ..... 10-2012-0024152

(51) Int. Cl.
*A47L 9/10* (2006.01)
*A47L 9/14* (2006.01)

(52) U.S. Cl.
CPC ..... *A47L 9/10* (2013.01); *A47L 9/1427* (2013.01); *A47L 9/1472* (2013.01); *A47L 2201/00* (2013.01)

(58) Field of Classification Search
CPC ..... A47L 9/1472; A47L 2201/00
USPC ..... 73/431; 15/339; 116/305
See application file for complete search history.

(56) References Cited

U.S. PATENT DOCUMENTS 4,733,430 A * 3/1988 Westergren ..... A47L 9/1427 116/268
4,733,431 A * 3/1988 Martin ..... A47L 9/1427 116/268
6,073,302 A * 6/2000 Buscher ..... 15/339
2006/0016043 A1* 1/2006 Matsuhashi ..... A47L 9/122 15/353
2006/0248676 A1* 11/2006 Baek ..... 15/319
2007/0039293 A1* 2/2007 Baek et al. ..... 55/354
2007/0044821 A1* 3/2007 Bertram ..... A47L 9/108 134/18
2008/0201897 A1* 8/2008 Nakai ..... A47L 9/0477 15/339
2012/0095597 A1* 4/2012 Kim ..... A47L 5/28 700/259
2012/0134895 A1* 5/2012 Kanda ..... G01N 1/405 422/534
2013/0025085 A1 1/2013 Kim et al.
2014/0359966 A1* 12/2014 Han ..... A47L 9/1683 15/327.1

FOREIGN PATENT DOCUMENTS

| | | |
|---|---|---|
| EP | 1719442 | 11/2006 |
| EP | 1752077 | 2/2007 |
| KR | 1020070018641 | 2/2007 |
| KR | 1020100040761 | 4/2010 |

* cited by examiner

*Primary Examiner* — Joseph J Hail
*Assistant Examiner* — Henry Hong
(74) *Attorney, Agent, or Firm* — Dentons US LLP

(57) ABSTRACT

There is provided a robot cleaner including a main body, a suction unit that sucks air including foreign substances into the main body, a moving unit that moves the main body, a dust collecting unit that has a filter for filtering the foreign substances included in the air sucked by the suction unit and a dust collecting case that collects the foreign substances filtered by the filter, and a detection unit that detects whether or not the filter is attached to the main body.

14 Claims, 7 Drawing Sheets

ROBOT CLEANER

CROSS-REFERENCE TO RELATED APPLICATIONS

The present application claims priority under 35 U.S.C. 119 and 35 U.S.C. 365 to Korean Patent Application No. 10-2012-0024152 (filed on Mar. 8, 2012), which is hereby incorporated by reference in its entirety.

BACKGROUND

The present disclosure relates to a robot cleaner.

The robot cleaner is an electrical appliance that performs a cleaning operation of removing foreign substances while running on a certain cleaning target region. The robot cleaner is provided with a dust collecting unit for collecting the foreign substances sucked together with air. The dust collecting unit includes a filter for filtering the foreign substances from the air and a dust collecting case for collecting the filtered foreign substances by the filter. The dust collecting case is detachably provided in the robot cleaner, and the filter is detachably provided at the dust collecting case.

Disadvantageously, in a conventional robot cleaner, the robot cleaner is operated while only the dust collecting case is attached to the robot cleaner without attaching the filter thereto. In such a case, since the foreign substances sucked together with the air into the robot cleaner are not filtered by the filter, the foreign substances are discharged to the outside of the robot cleaner. Accordingly, it may be difficult to accurately operate the cleaning operation by the robot cleaner.

SUMMARY

In accordance with embodiments, there is provided a robot cleaner.

In accordance with one aspect, there is provided a robot cleaner including a main body, a suction unit that sucks air including foreign substances into the main body, a moving unit that moves the main body, a dust collecting unit that has a filter for filtering the foreign substances included in the air sucked by the suction unit and a dust collecting case for collecting the foreign substances filtered by the filter, and a detection unit that detects whether or not the filter is attached to the main body.

In accordance with another aspect, there is provided a robot cleaner including a main body at which a settling portion is formed, a suction unit provided at the main body to suck air including foreign substances into the main body, a moving unit provided at the main body to move the main body, a dust collecting unit that is settled in the settling portion and has a filter for filtering the foreign substances included in the air sucked by the suction unit, a detection unit that detects the filter of the dust collecting unit mounted in the settling portion, and a control unit that restricts an operation of the suction unit when the filter is not detected by the detection unit.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
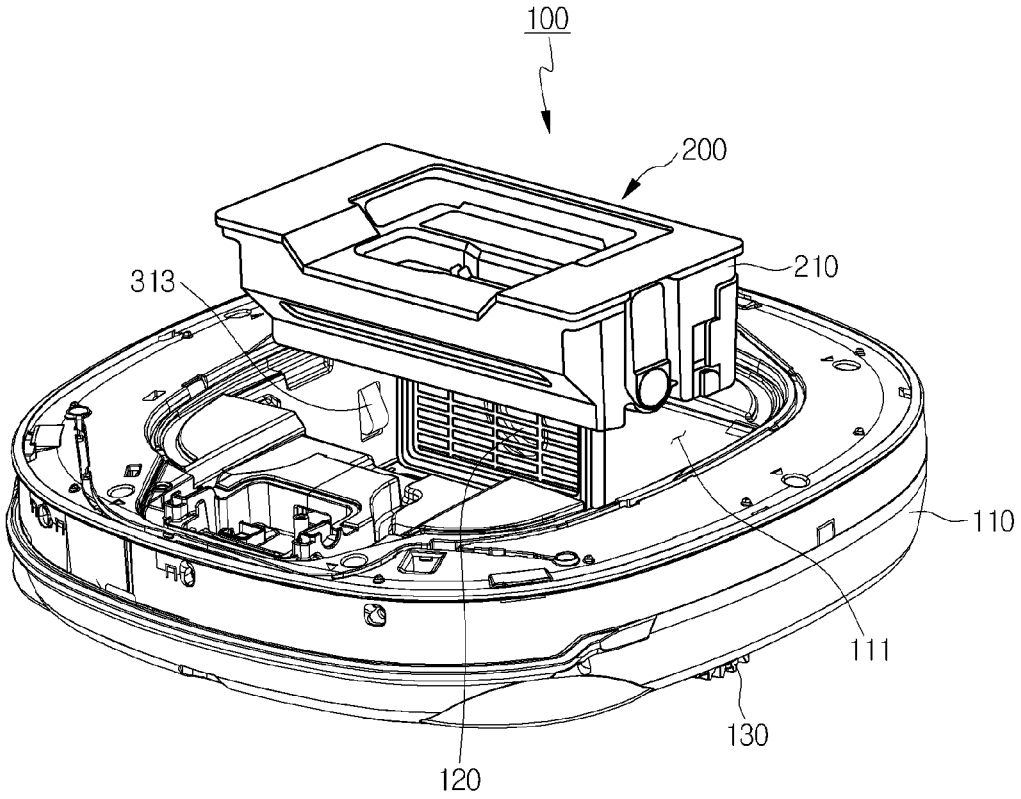
FIG. 1 is an exploded perspective view of a robot cleaner in accordance with a first embodiment.
Figure 2:
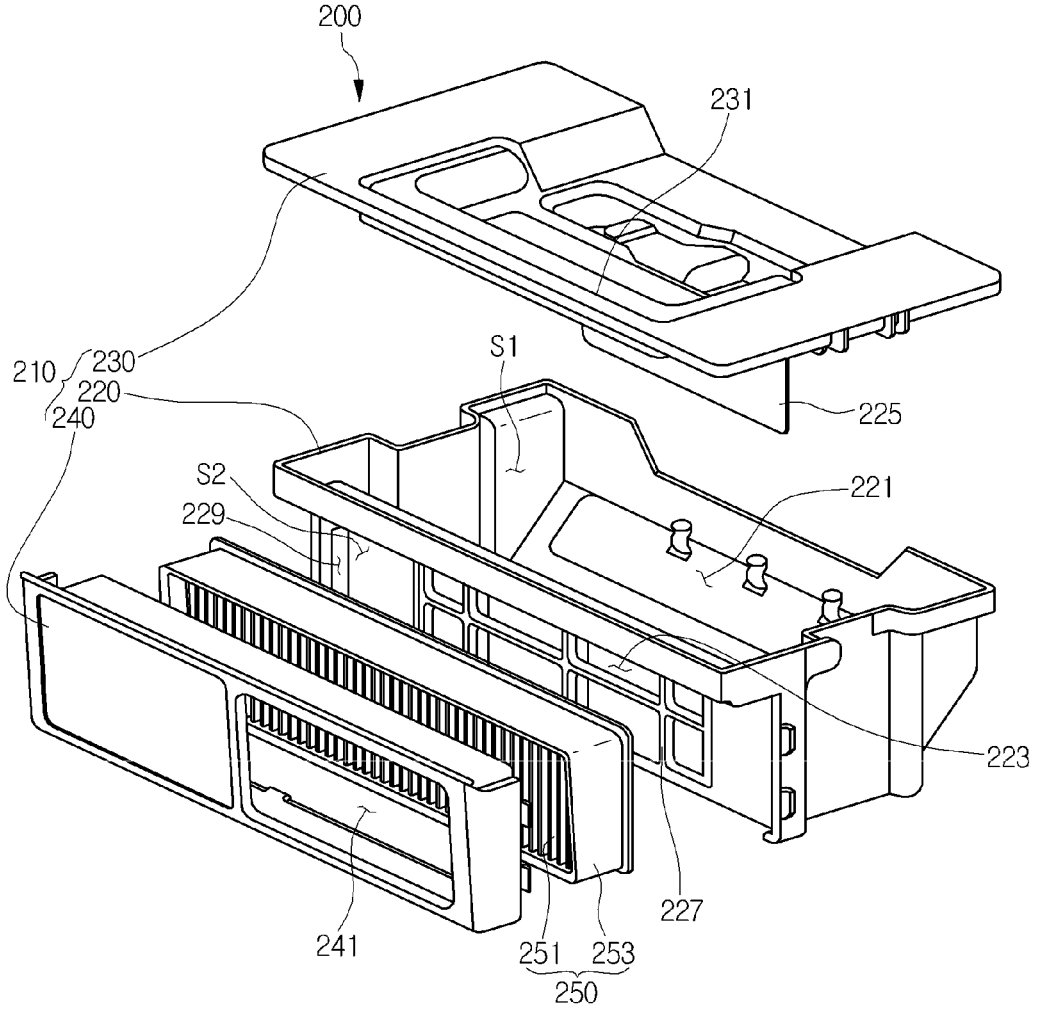
FIG. 2 is an exploded perspective view of a dust collecting unit in accordance with the first embodiment.
Figure 3:
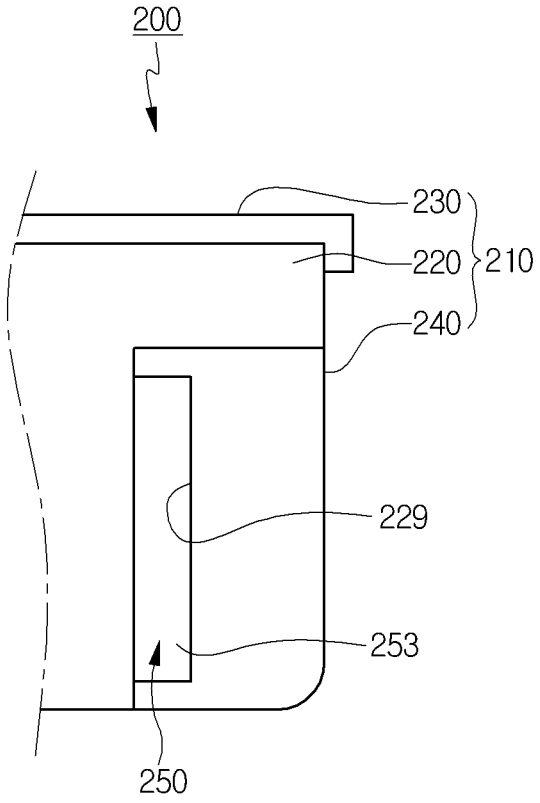
FIG. 3 is a side view illustrating a major part of the dust collecting unit in accordance with the first embodiment.
Figure 4:
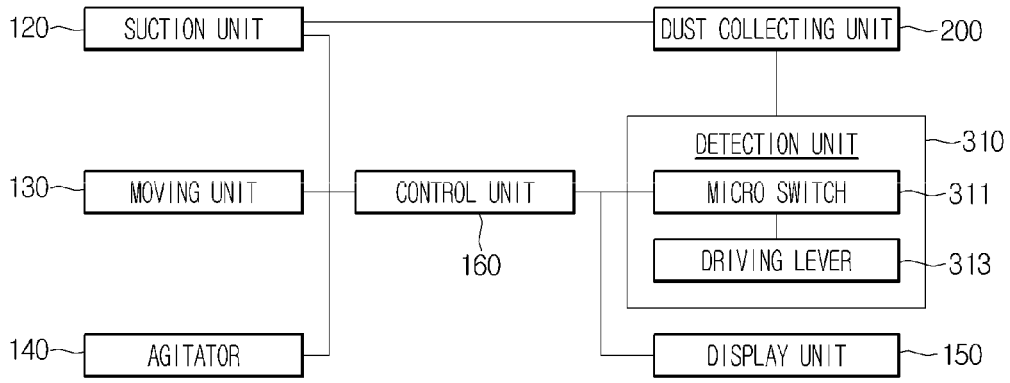
FIG. 4 is a block diagram of the robot cleaner in accordance with the first embodiment.

FIG. 1 is an exploded perspective view of a robot cleaner in accordance with a first embodiment, FIG. 2 is an exploded perspective view of a dust collecting unit in accordance with the first embodiment, FIG. 3 is a side view illustrating a major part of the dust collecting unit in accordance with the first embodiment, and FIG. 4 is a block diagram of the robot cleaner in accordance with the first embodiment.

First, referring to FIG. 1, a robot cleaner 100 includes a main body 110 having a suction opening. The suction opening is provided to suck air including foreign substances into the robot cleaner 100, specifically, the main body 110. Further, a discharge opening (not shown) is formed in one side of the main body 110. The discharge opening is provided to discharge the air including the foreign substances sucked into the robot cleaner 100, that is, the main body 110, through the suction opening to the outside of the main body 110.

Meanwhile, various parts of the robot cleaner 100 are provided within the main body 110. By way of example, a suction unit 120 (see FIG. 4), a moving unit 130, and an agitator 140 may be installed within the main body 110. The suction unit 120 supplies a driving force for sucking the air including the foreign substances into the robot cleaner 100, that is, the main body 110. The moving unit 130 supplies a driving force for running the robot cleaner 100. The agitator 140 is exposed to the outside through the suction opening to remove the foreign substances from a cleaning target object.

A settling groove 111 (or a settling portion) is formed at a top surface of the main body 110. The settling groove 111 is formed such that a part of the main body 110 is hollowed downward. A dust collecting unit 200 to be described below is settled in the settling groove 111. By way of example, the settling groove 111 may be formed such that a part of the main body 110 is hollowed downward in a substantially hexahedral shape, but is not limited thereto. The settling groove 111 is located at a flow path of the air, which is sucked into the main body 110 through the suction opening and is then discharged to the outside of the main body 110 through the discharge opening.

Although not shown, a cover is coupled to the main body 110. The cover serves to open or close the settling groove 111. To achieve this, the cover is rotatably provided at the main body 110.

Meanwhile, the dust collecting unit 200 is detachably provided at the main body 110. The dust collecting unit 200 is vertically fixed to the main body 110. The foreign substances included in the air sucked by the suction unit 120 are collected in the dust collecting unit 200.

Referring to FIGS. 2 and 3, the dust collecting unit 200 includes a dust collecting case 210 and a filter 250.

The dust collecting case 210 defines a dust collecting space S1 in which the substances are collected. The dust collecting case 210 includes a case body 220, a case cover 230, and a filter bracket 240.

The case body 220 is formed in a substantially polyhedral shape having a top opening, but is not limited thereto. A suction hole 221 and a communication hole 223 are formed in the case body 220. The suction hole 221 and the communication hole 223 are formed by cutting off part of two surfaces of the case body 220 facing each other, respectively. The suction hole 221 serves to suck the air including the foreign substances into the dust collecting space S1 by the suction unit 120.

The communication hole 223 serves to deliver the air, which has been sucked into the dust collecting space S1 by the suction unit 120 and then filtered by the filter 250 to remove the foreign substances, toward the discharge hole 241 to be described below.

In addition, a damper 225 is provided at the case body 220. The damper 225 serves to selectively open or close the suction hole 221. To achieve this, the damper 225 may be rotatably provided at the case body 220. FIG. 2 illustrates an example case where the damper 225 is separated from the case body 220.

The damper 225 is rotated along with the flow of the air sucked into the dust collecting space S1 through the suction hole 221 to open the suction hole 221.

A support rib 227 is provided at the case body 220. The support rib 227 is provided in the case body 220 adjacent to the communication hole 223 in a substantially lattice shape. The support rib 227 serves to support the filter 250 provided at the communication hole 223.

A filter mounting space S2 is formed in the case body 220. The filter 250 is mounted in the filter mounting space S2. The filter mounting space S2 may be defined by the filter bracket 240 and parts of both side surfaces of the case body 220.

Further, a filter exposing opening 229 is formed in the case body 220. A part of the filter 250 mounted in the filter mounting space S2 is exposed to the outside of the dust collecting case 210 through the filter exposing opening 229.

By way of example, the filter exposing opening 229 may be formed by cutting off the part of the side surface of the case body 220 for defining the filter mounting space S2.

The case cover 230 selectively opens or closes the top surface of the case body 220. To achieve this, the case cover 230 is selectively fixed to the case body 220 in a tight fit manner, for example. Alternatively, the case cover 230 may be rotatably provided at the case body 220. When the case cover 230 is rotatably provided at the case body 220, the case cover 230 is fixed to the case body 220 while covering the case body 220. A handle 231 held by a user may be provided at the case cover 230 to fix the dust collecting unit 200 onto the settling groove 111 or separate the dust collecting unit 200 from the settling groove 111.

The filter bracket 240 serves to fix the filter 250 mounted in the filter mounting space S2. To achieve this, the filter bracket 240 is fixed to the case body 220 to cover the filter mounting space S2. Moreover, the discharge hole 241 is formed in the filter bracket 240. The discharge hole 241 is formed by cutting off a part of the filter bracket 240. The discharge hole 241 is provided to discharge the air, which has been sucked into the dust collecting space S1 and then filtered by the filter 250 to remove the foreign substances, to the outside of the dust collecting space S1. Specifically, the discharge hole 241 is communicated with the discharge opening when the dust collecting unit 200 is settled in the settling groove 111. In this embodiment, the discharge hole 241 has a flow path cross-sectional area relatively narrower than that of the communication hole 223.

The filter 250 serves to filter the foreign substances included in the air sucked into the dust collecting space S1. The filter 250 is mounted in the filter mounting space S2. The filter 250 includes a filtering member 251 and a filter frame 253. The filtering member 251 may have a longitudinal cross section having a size that is substantially equal to that of the communication hole 223. Thus, an area of the filter 250 is relatively greater than the flow path cross-sectional area of the discharge hole 241.

The filter frame 253 is provided at a rim of the filtering member 251. Specifically, when the filter 250 is mounted in the filter mounting space S2, a part of the filter frame 253 is exposed to the outside of the dust collecting space S1 through the filter exposing opening 229.

Referring back to FIGS. 1 and 4, a detection unit 310 is provided within the settling groove 111. The detection unit 310 serves to detect whether or not the dust collecting unit 200 with the filter 250 attached thereto is settled in the settling groove 111. In this embodiment, the detection unit 310 includes a micro switch 311 and a driving lever 313. The micro switch 311 is turned on or off depending on whether or not the filter 250 is attached to the dust collecting unit 200 settled in the settling groove 111. The driving lever 313 is provided at one side of the settling groove 111, and is selectively driven by the filter 250 to turn on or off the micro switch 311 when the dust collecting unit 200 is settled in the settling groove 111. Specifically, an actuator (not shown) of the micro switch 311 is driven by the driving lever 313. By way of example, when the dust collecting unit 200 with the filter 250 attached thereto is settled in the settling groove 111, the driving lever 313 is pressed by the filter 250 exposed through the filter exposing opening 229 to turn on the micro switch 311. When the dust collecting unit 200 is not settled in the settling groove 111, or when the dust collecting unit 200 is settled in the settling groove 111 while the filter 250 is not attached thereto, the driving lever 313 is not pressed by the filter 250, and the driving lever 313 is located at the filter exposing opening 229. Accordingly, the micro switch 311 is maintained in a turned off state. Otherwise, the driving lever 313 may not be provided, and the actuator of the micro switch 311 may be directly driven by the filter 250.

The display unit 150 displays information about the robot cleaner 100, that is, information about the cleaning operation. Especially, in this embodiment, the display unit 150 displays whether or not the filter 250 is attached to the dust collecting unit 200 settled in the settling groove 111. By way of example, when the filter 250 is not attached to the dust collecting unit 200 settled in the settling groove 111, the display unit 150 may display a signal for notifying the user of the unmounted state of the filter 250.

Meanwhile, a control unit 160 controls the robot cleaner 100. To achieve this, the control unit 160 may control at least operations of the suction unit 120, the moving unit 130, the agitator 140, and the display unit 150. In this embodiment, the control unit 160 may control an operation of the robot cleaner 100 depending on whether or not the dust collecting unit 200 with the filter 250 attached thereto is settled in the settling groove 111. More specifically, when the detection unit 310 detects that the dust collecting unit 200 with the filter 250 attached thereto is settled in the settling groove 111, the control unit 160 controls the robot cleaner 100 to operate the cleaning operation. Meanwhile, even though the filter 250 is not attached to the dust collecting unit 200, when the detection unit 310 detects that the dust collecting unit 200 is settled in the settling groove 111, the control unit 160 controls the suction unit 120 not to be operated. In addition, the control unit 160 may control the moving unit 130 and/or the agitator 140 not to be operated.

In cases other than a case where it is detected that the dust collecting unit 200 with the filter 250 attached thereto is settled in the settling groove 111, the control unit 160 may control the display unit 150 to display the signal for notifying the user of the unmounted state of the filter 250.

Further, although not illustrated, a rechargeable battery may be provided in the main body 110. The rechargeable battery supplies power for operating various part of the robot cleaner 100.

Hereinafter, the operation of the robot cleaner in accordance with the present invention will be explained.

First, when a signal of starting the operation of the robot cleaner 100, that is, the cleaning operation, is input by the user, the operations of the suction unit 120 and the moving unit 130 are started by the control unit 160, and then the cleaning operation is performed to remove the foreign substances while running on the certain cleaning target region.

Moreover, the operations of the agitator 140 and the display unit 150 are started by the control unit 160 to display information about the removal of the foreign substances from the cleaning target object and the cleaning operation.

More specifically, when the suction unit 120 is operated, the air including the foreign substances is sucked into the main body 110 through the suction opening. In this way, the air sucked into the main body 110 passes through the dust collecting unit 200 by the continuous operation of the suction unit 120. That is, the air including the foreign substances is sucked into the dust collecting space S1 through the suction hole 221. The air sucked in the dust collecting space S1 passes through the filter 250 to filter the foreign substances, and is then discharged to the outside of the dust collecting space S1 through the discharge hole 241. At this time, the foreign substances filtered by the filter 250 are collected in the dust collecting space S1. The air discharged to the outside of the dust collecting space S1, that is, the outside of the dust collecting unit 200, through the discharge hole 241 is discharged to the outside of the main body 110 through the discharge opening.

Meanwhile, in this embodiment, the operation of the robot cleaner 100 may be controlled depending on whether or not the dust collecting unit 200 with the filter 250 attached thereto is settled in the settling groove 111.

That is, only when the detection unit 310 detects that the dust collecting unit 200 with the filter 250 attached to thereto is settled in the settling groove 111, the control unit 160 controls at least the operation of the suction unit 120 to operate the aforementioned cleaning operation. In other words, in cases other than a case where the detection unit 310 detects that the dust collecting unit 200 with the filter 250 attached thereto is settled in the settling groove 111, the control unit 160 controls at least the suction unit 120 not to be operated.

In conclusion, even though the unmounted state of the filter 250 is detected, when a command to operate the main body 110 is received, the suction unit 120 and the moving unit 130 may not be operated (the operations of the suction unit and the moving unit are restricted).

In this embodiment, an area of the filter 250 has a value relatively higher than that of the flow path cross-section area of the discharge hole 241. Accordingly, even though the filter 250 having a size substantially equal to that of the discharge hole 241, specifically, the filtering member 251, is disturbed by the foreign substances such that the air does not pass through the filtering member 251, the air can pass through the other portion of the filtering member 251.

Figure 5:
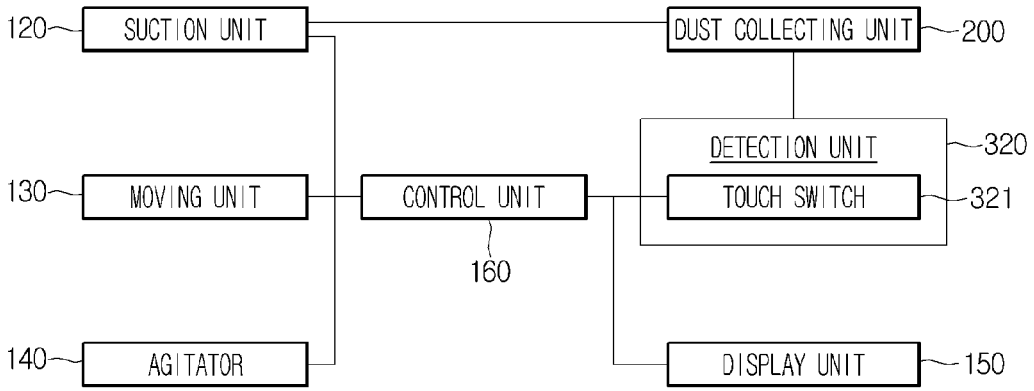
FIG. 5 is a schematic configuration diagram of a robot cleaner in accordance with a second embodiment.

FIG. 5 is a schematic configuration diagram of a robot cleaner in accordance with a second embodiment. In this embodiment, the same parts as those in the first embodiment of the present invention will be assigned the same reference numerals as those in FIGS. 1 to 4, and redundant description thereof will be omitted.

Referring to FIG. 5, in this embodiment, the detection unit 320 for detecting whether or not the dust collecting unit 200 with the filter 250 attached thereto is settled in the settling groove 111 includes a touch switch 321. The touch switch 321 is provided at one side of the settling groove 111. The touch switch 321 is turned on or off by the filter 20, specifically, one side of the filter 20 exposed through the filter exposing opening 229 when the dust collecting unit 200 is settled in the settling groove 111.

Figure 6:
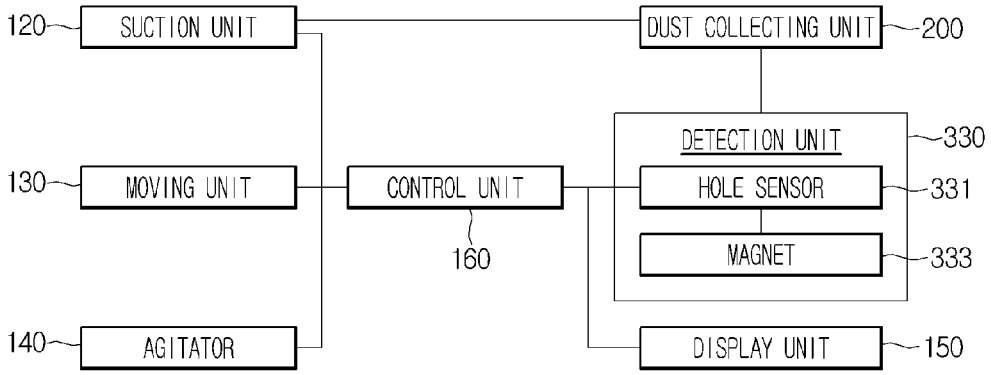
FIG. 6 is a schematic configuration diagram of a robot cleaner in accordance with a third embodiment.

FIG. 6 is a schematic configuration diagram of a robot cleaner in accordance with a third embodiment. In this embodiment, the same parts as those in the first embodiment of the present invention will be assigned the same reference numerals as those in FIGS. 1 to 4, and redundant description thereof will be omitted.

Referring to FIG. 6, in this embodiment, a detection unit 330 for detecting whether or not the dust collecting unit 200 with the filter 250 attached thereto is settled in the settling groove 111 includes a hole sensor 331 and a magnet 333. The hole sensor 331 is provided at one side of the settling groove 111. The magnet 333 may be provided at the filter 250. When the dust collecting unit 200 is settled in the settling groove 111, the hole sensor 331 detects magnetism of the magnet 333, so that the detection unit 330 detects whether or not the dust collecting unit 200 with the filter 250 attached thereto is settled in the settling groove 111. In this embodiment, the filter exposing opening 229 may be removed depending on the magnitude of a magnetic field of the magnet 333.

Figure 7:
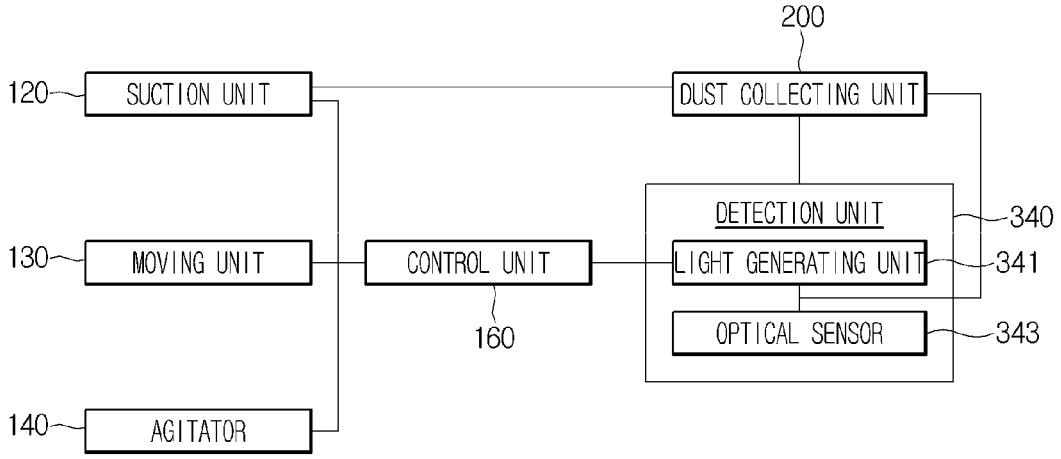
FIG. 7 is a schematic configuration diagram of a robot cleaner in accordance with a fourth embodiment.

FIG. 7 is a schematic configuration diagram of a robot cleaner in accordance with a fourth embodiment. In this embodiment, the same parts as those in the first embodiment of the present invention will be assigned the same reference numerals as those in FIGS. 1 to 4, and redundant description thereof will be omitted.

Referring to FIG. 7, in this embodiment, a detection unit 340 for detecting whether or not the dust collecting unit 200 with the filter 250 attached thereto is settled in the settling groove 111 includes a light generating unit 341 and an optical sensor 343. The light generating unit 341 generates light in a predetermined direction, and the optical sensor 343 detects the light generated by the light generating unit 341. Light transmitting openings (not shown) are formed in the dust collecting unit 200, that is, the dust collecting case 210. When the dust collecting unit 200 is settled in the settling groove 111, the light transmitting openings are located at a path of the light generated by the light generating unit 341. Specifically, the filter exposing opening 229 in the first embodiment of the present invention is formed in both side surfaces of the case body 220, respectively, and thus the light transmitting openings are formed. The light transmitting openings are selectively opened or closed by the dust collecting case 210, that is, the filter 250 mounted in the filter mounting space S2. Specifically, the light transmitting openings are formed by respectively cutting off parts of the dust collecting case 210, which are two surfaces of the filter mounting space S2 facing each other.

Accordingly, in this embodiment, when the dust collecting unit 200 with the filter 250 attached thereto is settled in the settling groove 111, the optical sensor 343 does not detect the light generated by the light generating unit 341. However, in cases other than a case where the dust collecting unit 200 with the filter 250 attached thereto is settled in the settling groove 111, the optical sensor 343 detects the light generated by the light generating unit 341. That is, the filter 250 is located between the light generating unit 341 and the optical sensor 343.

It should be understood by those skilled in the art that various modifications can be made without changing the technical conception of the present invention, and that the scope of the present invention is defined by the appended claims.

The aforementioned embodiments has been described that in cases other than a case where the detection unit detects that the dust collecting case with the filter attached thereto is settled in the settling groove, the control unit controls the operation of the suction unit. However, when the detection unit includes the micro switch or a touch switch, power supplied to the suction unit is directly shut off depending on the turned on operation or the turned off operation of the micro switch or the touch switch.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner, comprising:

a main body;

a suction unit that sucks air including foreign substances into the main body;

a moving unit that moves the main body;

a dust collecting unit that has a filter for filtering the foreign substances included in the air sucked by the suction unit and a dust collecting case that collects the foreign substances filtered by the filter;

a detection unit that detects whether the filter is attached to the main body in a state where the dust collection case is attached to the main body; and a control unit configured to control the suction unit, wherein the filter is detachably coupled to the dust collecting case, and the filter is attached to the main body in a state which the filter is attached to the dust collecting case, wherein the dust collecting case comprises an opening for exposing a part of the filter to an outside of the dust collecting case and a communication hole through which air filtered by the filter passes, and wherein the detection unit detects the filter exposed through the opening, wherein the control unit allows an operation of the suction unit when the detection unit detects the filter in a state which the dust collecting case is attached to the main body, wherein the control unit restricts an operation of the suction unit when the detection unit cannot detect the filter in a state which the dust collecting case is attached to the main body.

2. The robot cleaner of claim 1, wherein the detection unit includes a micro switch turned on or off by the filter.

3. The robot cleaner of claim 2, wherein the micro switch is turned on or off by the filter exposed through the opening.

4. The robot cleaner of claim 2, wherein a driving lever operated by the filter exposed through the opening is provided at the main body to turn on or off the micro switch.

5. The robot cleaner of claim 1, wherein the detection unit includes a touch switch turned on or off by being touched by the filter.

6. The robot cleaner of claim 5, wherein the touch switch is touched by the filter exposed through the opening.

7. The robot cleaner of claim 1, wherein the detection unit includes a light generating unit provided at the main body and an optical sensor for detecting light irradiated from the light generating unit.

8. The robot cleaner of claim 7, wherein the filter is located between the light generating unit and the optical sensor when the filter is attached to the main body.

9. The robot cleaner of claim 1, further comprising:

a display unit that, when a command to operate the main body is received even though an unmounted state of the filter is detected, displays information for notifying of the unmounted state of the filter.

10. The robot cleaner of claim 1, wherein, when a command to operate the main body is received even though an unmounted state of the filter is detected, the suction unit is not operated.

11. The robot cleaner of claim 1, wherein when a command to operate the main body is received even though an unmounted state of the filter is detected, the moving unit is not operated.

12. A robot cleaner, comprising:

a main body at which a settling portion is formed;

a suction unit provided at the main body to suck air including foreign substances into the main body;

a moving unit provided at the main body to move the main body;

a dust collecting unit that is settled in the settling portion and has a filter for filtering the foreign substances included in the air sucked by the suction unit, and a dust collecting case to which the filter is detachably coupled;

a detection unit that detects the filter of the dust collecting unit mounted in the settling portion; and a control unit configured to control the suction unit, wherein the dust collecting case comprises an opening for exposing a part of the filter to an outside of the dust collecting case and a communication hole through which air filtered by the filter passes, and wherein the detection unit detects the filter exposed through the opening, wherein the control unit allows an operation of the suction unit when the detection unit detects the filter in a state which the dust collecting case is settled in the settling portion, wherein the control unit restricts an operation of the suction unit when the detection unit cannot detect the filter in a state which the dust collecting case is settled in the settling portion.

13. The robot cleaner of claim 12, further comprising:

a display unit that, when the filter is not detected by the detection unit, displays information for notifying the unmounted state of the filter.

14. The robot cleaner of claim 12, wherein the detection unit includes a light generating unit provided at the settling portion and an optical sensor for detecting light irradiated from the light generating unit.

* * * * *